US005580213A

United States Patent [19]

Woodward et al.

[11] Patent Number: 5,580,213

[45] Date of Patent: Dec. 3, 1996

[54] ELECTRIC FUEL PUMP FOR MOTOR VEHICLE

[75] Inventors: Orrin A. Woodward, Grand Blanc, Mich.; Edward A. Hantle, deceased, late of Caro, Mich., by Kathleen A. Hantle, legal representative; David E. Harris, Frankenmuth, Mich.

[73] Assignee: General Motors Corporation, Detroit, Mich.

[21] Appl. No.: 571,424

[22] Filed: Dec. 13, 1995

[51] Int. Cl.[6] ..... F04D 5/00

[52] U.S. Cl. ..... 415/55.1; 415/55.5; 415/55.6

[58] Field of Search ..... 415/55.1, 55.2, 415/55.5, 55.6, 55.7

[56] References Cited

U.S. PATENT DOCUMENTS

| | | | |
|---|---|---|---|
| 3,324,799 | 6/1967 | Terrano . | |
| 3,881,839 | 5/1975 | MacManus | 415/55.1 |
| 4,408,952 | 10/1983 | Schweinfurter . | |
| 4,556,363 | 12/1985 | Watanabe et al. . | |
| 4,566,866 | 1/1986 | Kemmner . | |
| 4,678,395 | 7/1987 | Schweinfurter . | |
| 4,766,315 | 10/1988 | Greiner . | |
| 4,865,522 | 9/1989 | Radermacher . | |
| 4,923,365 | 5/1990 | Rollwage . | |
| 5,080,554 | 1/1992 | Kamimura . | |
| 5,129,796 | 7/1992 | Emmert et al. | 417/435 X |
| 5,284,417 | 2/1994 | Yu | 415/55.1 |
| 5,336,045 | 8/1994 | Koyama et al. | 415/55.1 |
| 5,338,151 | 8/1994 | Kemmner et al. | 415/55.1 |
| 5,348,442 | 9/1994 | Harris et al. | 415/55.1 |
| 5,378,125 | 1/1995 | Frank et al. | 415/55.1 |
| 5,413,457 | 5/1995 | Tuckey | 415/55.6 |
| 5,509,778 | 4/1996 | Hantle et al. | 415/55.1 |

*Primary Examiner*—Edward K. Look
*Assistant Examiner*—Michael S. Lee
*Attorney, Agent, or Firm*—Saul Schwartz

[57] ABSTRACT

A motor vehicle fuel pump including an electric motor, a high pressure pump, and a low pressure pump having a side channel pumping stage for pumping fuel from a fuel tank to a reservoir and a regenerative turbine pumping stage for pumping fuel from the reservoir to the high pressure pump. A pair of radial vapor ports are disposed between an inside diameter of a pump channel of the turbine pumping stage and an outside diameter of a concentric, radially inboard pump channel of the side channel pumping stage at a discharge port of the pump channel of the side channel pumping stage. Liquid fuel with entrained vapor near the inside diameter of the pump channel of the turbine pumping stage is aspirated through the radial vapor ports into the discharge port of the pump channel of the side channel pumping stage by liquid fuel flowing in the pump channel of the side channel pumping stage.

5 Claims, 4 Drawing Sheets

ELECTRIC FUEL PUMP FOR MOTOR VEHICLE

FIELD OF THE INVENTION

This invention relates to electric fuel pumps for motor vehicles.

BACKGROUND OF THE INVENTION

A motor vehicle fuel pump described in U.S. patent application Ser. No. 08/391,856, filed 22 Feb. 1995 (now U.S. Pat. No. 5,509,778) and assigned to the assignee of this invention, includes an electric motor, a high pressure pump, and a low pressure regenerative turbine pump ahead of the high pressure pump. The low pressure pump includes an annular pump channel, an impeller having peripheral vanes in the pump channel, a pair of radial vapor ports at an inside diameter of the pump channel on opposite sides of the impeller, and a pair of sidewall steps in the pump channel extending between an outside diameter and an inside diameter of the pump channel from ahead of the vapor ports to downstream sides thereof. The sidewall steps promote vapor separation by smoothly guiding liquid fuel with entrained vapor to the radial vapor ports.

U.S. Pat. No. 5,129,796, issued 14 Jun. 1992 and assigned to the assignee of this invention, describes a motor vehicle fuel pump including an electric motor, a high pressure pump, and a low pressure pump in which two separate regenerative turbine pumping stages are derived from vanes on opposite sides of a single impeller in a pump channel around the periphery of the impeller. The first pumping stage transfers fuel from a fuel tank into a reservoir in which the fuel pump is mounted. The second pumping stage transfers fuel from the reservoir to the high pressure pump. Liquid fuel with entrained vapor is expelled radially inward from the second pumping stage through clearance between a side of the impeller and an adjacent side of the housing in which the pump channel is formed.

SUMMARY OF THE INVENTION

This invention is a new and improved motor vehicle fuel pump including an electric motor, a high pressure pump, and a low pressure pump having a side channel pumping stage and a regenerative turbine pumping stage. The side channel pumping stage pumps fuel from a fuel tank to a reservoir and includes an annular inner vane set on an impeller of the low pressure pump and an annular groove defining a pump channel of the side channel pumping stage. The turbine pumping stage pumps fuel from the reservoir to the high pressure pump and purges vapor from liquid fuel flowing to the high pressure pump and includes an annular outer vane set around the periphery of the impeller concentric with the inner vane set and an annular pump channel around the outer vane set. The pump channel of the turbine pumping stage has a radial vapor port which intersects an outside diameter of the pump channel of the side channel pumping stage at a discharge port of the pump channel of the side channel pumping stage. When the electric motor is on, fuel flowing through the pump channel of the side channel pumping stage aspirates liquid fuel with entrained vapor through the radial vapor port from the pump channel of the turbine pumping stage to the discharge port of the pump channel of the side channel pumping stage. In a preferred embodiment, the radial vapor port is a smooth continuation of a sidewall step in the pump channel of the turbine pumping stage which further promotes purging of liquid fuel with entrained vapor from the pump channel of the turbine pumping stage through the radial vapor port.

DESCRIPTION OF A PREFERRED EMBODIMENT

Figure 1:
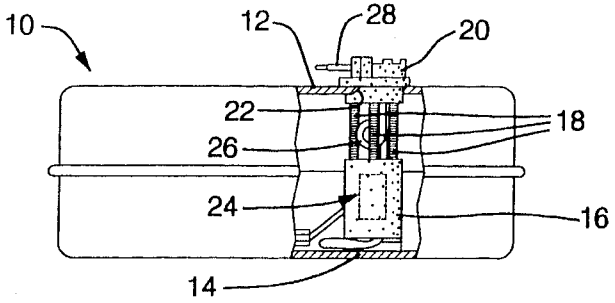
FIG. 1 is a partially broken-away view of a motor vehicle fuel tank having mounted therein an electric fuel pump according to this invention.
Figure 2:
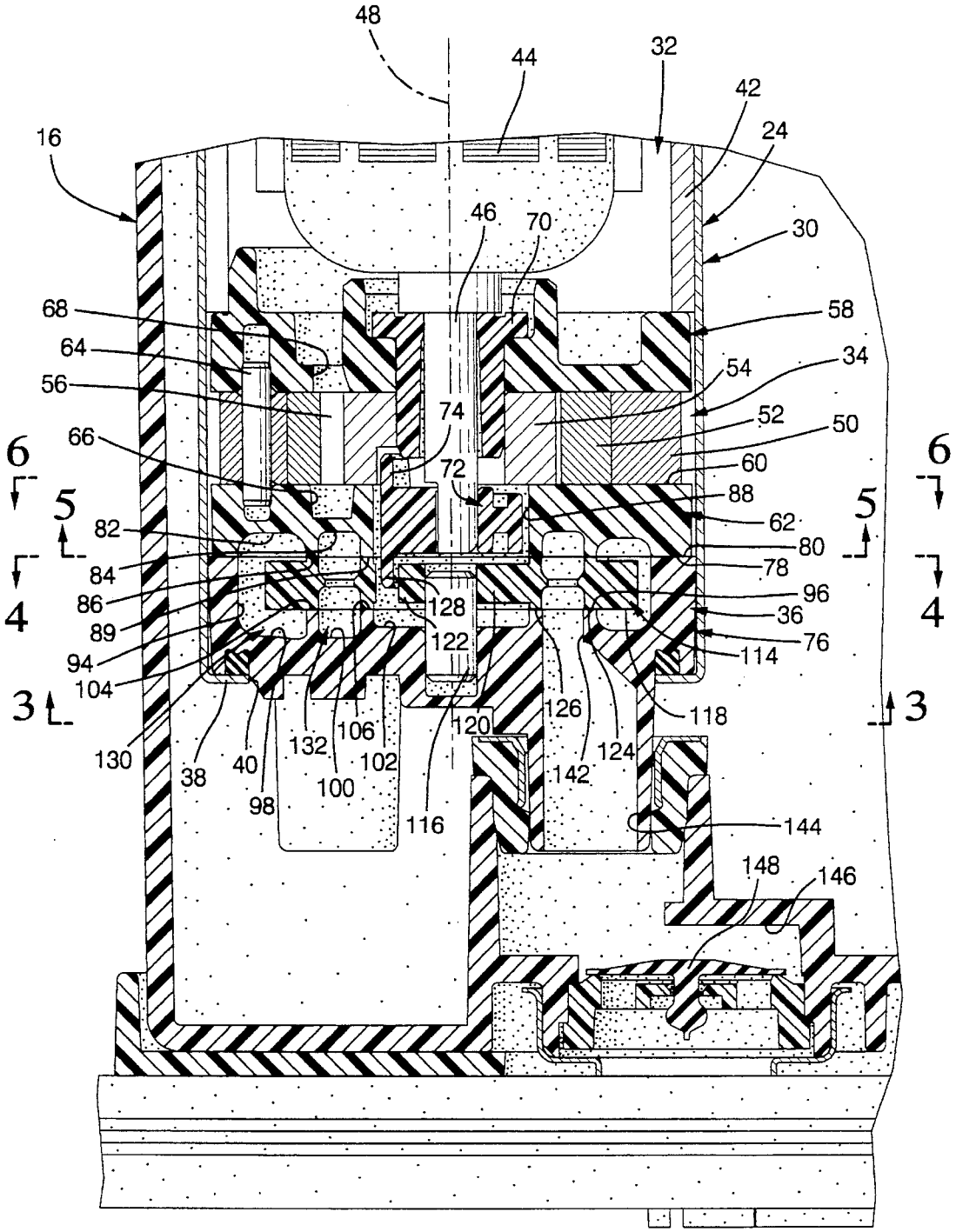
FIG. 2 is a fragmentary, partially broken-away view of an electric fuel pump according to this invention.
Figure 3:
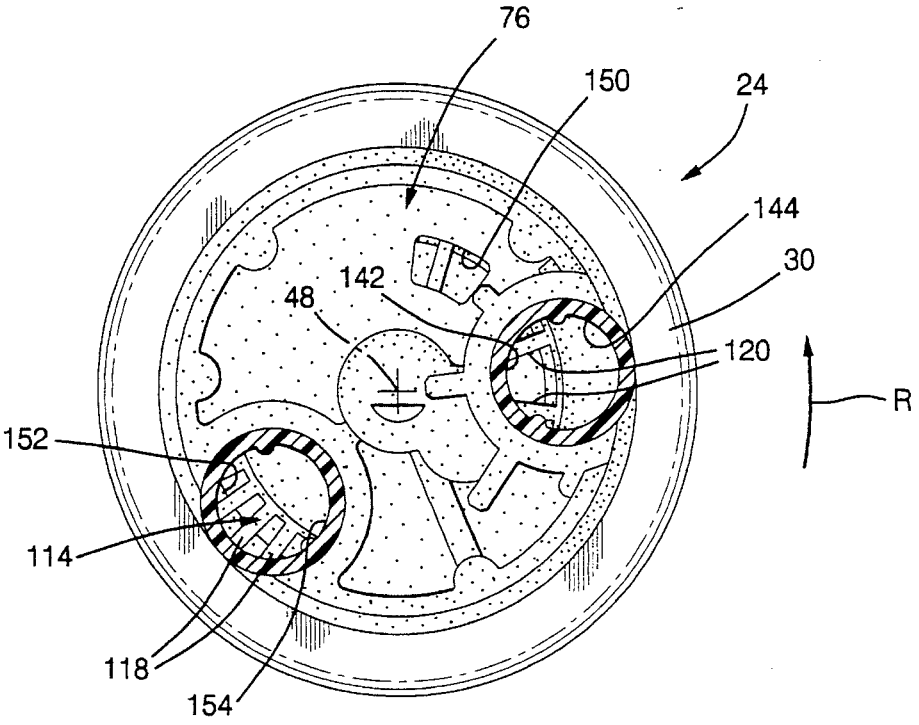
FIG. 3 is a sectional view taken generally along the plane indicated by lines 3—3 in FIG. 2.

As seen best in FIGS. 1–2, a motor vehicle fuel tank 10 has a top wall 12 and a bottom wall 14. A reservoir 16 in the fuel tank is biased against the bottom wall 14 by a plurality of resilient struts 18 between the reservoir and a cover 20 in an access opening 22 in the top wall 12 of the tank. A fuel pump 24 according to this invention is mounted vertically in the reservoir 16 and connected to an engine, not shown, of the motor vehicle through a flexible hose 26 inside the tank and a fluid connector 28 on the cover 20.

The fuel pump 24 includes a tubular housing 30, an electric motor 32 in the tubular housing, a high pressure pump 34 in the tubular housing, and a low pressure pump 36 in the tubular housing between the high pressure pump and a lip 38 around an opening 40 in the tubular housing. The electric motor 32 includes a cylindrical flux carrier 42 closely received in the tubular housing 30, an armature 44, and an armature shaft 46 rotatable with the armature about a longitudinal centerline 48 of the tubular housing 30 when the electric motor is on.

Figure 7:
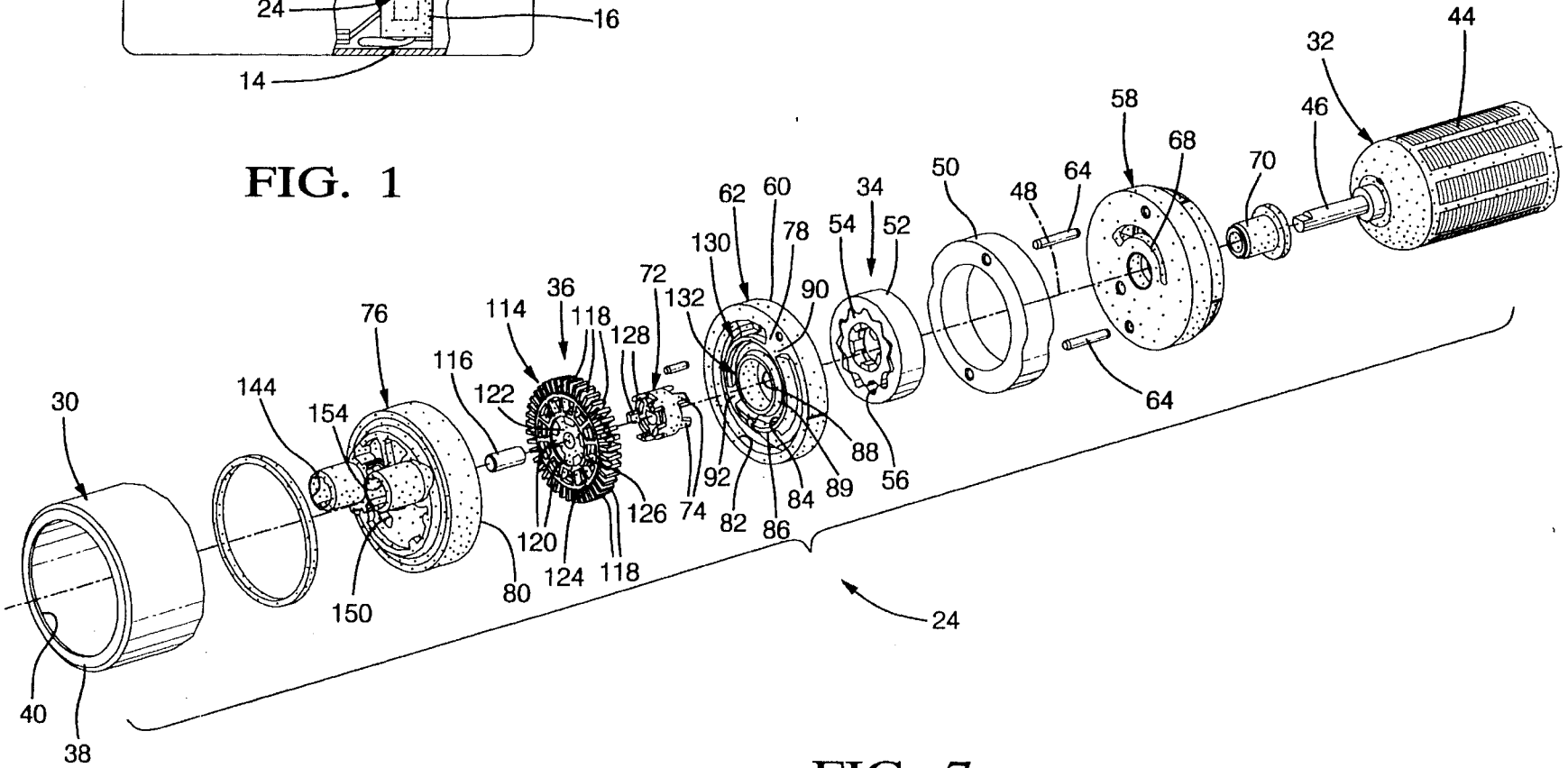
FIG. 7 is a fragmentary exploded perspective view of the electric fuel pump according to this invention.
Figure 6:
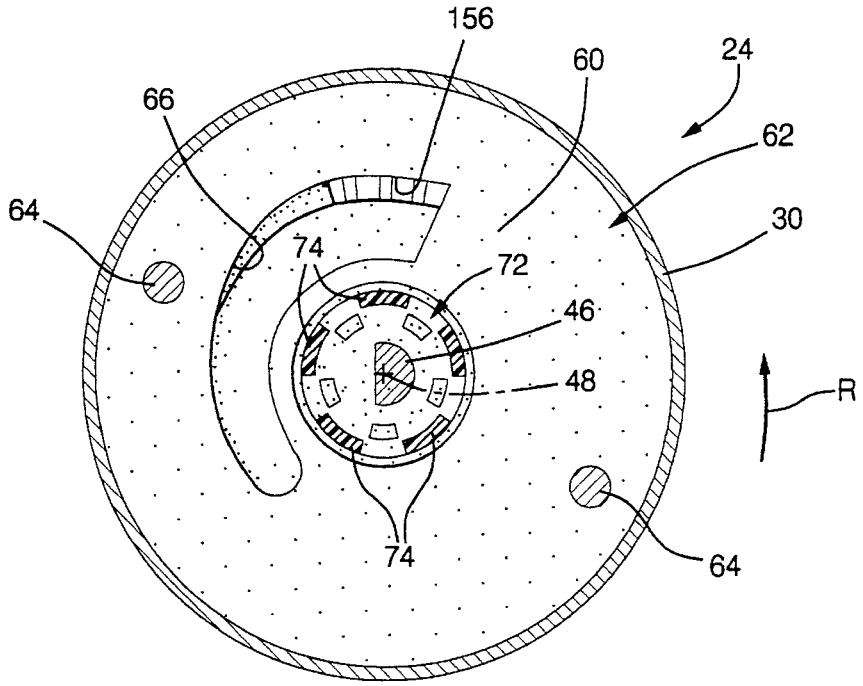
FIG. 6 is a sectional view taken generally along the plane indicated by lines 6—6 in FIG. 2.

As seen best in FIGS. 2, 6 and 7, the high pressure pump 34 of the preferred embodiment of the fuel pump 24 is a gerotor pump including a stationary ring 50, an internally toothed gear 52 rotatably supported in the stationary ring 50, and an externally toothed gear 54 meshing with the internally toothed gear 52 such that a crescent-shaped pump chamber 56 is defined between the gears. The crescent-shaped pump chamber 56 is closed on one side by an end plate 58 non-rotatably fitted in an end of the flux carrier 42 and on the other side by a flat side 60 of a disc-shaped first or upper housing 62 of the low pressure pump 36. A plurality of reaction pins 64 prevent relative rotation between the ring 50, the end plate 58, and the first housing 62.

Liquid fuel enters the crescent-shaped pump chamber 56 of the gerotor pump through an inlet port 66 in the flat side 60 of the first housing 62 and discharges into the interior of the tubular housing 30 around the armature 44 through a discharge port 68 in the end plate 58 which is illustrated out of position in FIG. 2 for clarity. Liquid fuel is discharged from the tubular housing 30 at the opposite end thereof, not shown. A bushing 70, FIGS. 2 and 7, on the end plate 58 supports the armature shaft 46 on the tubular housing 30 for rotation about the centerline 48. A barrel-shaped driver 72 rotates as a unit with the armature shaft 46 and is coupled to the externally toothed gear 54 of the gerotor pump by a plurality of drive tangs 74.

The low pressure pump 36 further includes, in addition to the first housing 62, a second or lower housing 76 captured between the first housing 62 and the lip 38 on the tubular housing 30. A flat side 78 of the first housing 62 bears against a flat side 80 of the second housing 76 and has formed therein an annular outer groove 82, a concentric annular inner groove 84 separated from the outer groove by an annular boss 86, and a center bore 88 surrounding the driver 72 separated from the inner groove by an annular boss 89. The outer groove 82 is interrupted by a stripper wall 90 in the plane of the flat side 78. The inner groove 84 is interrupted by a stripper wall 92 in the plane of the flat side 78, FIGS. 5 and 7.

A cavity in the flat side 80 of the second housing 76 has a cylindrical wall 94 and a circular flat bottom wall 96 parallel to the flat sides 78,80 of the first and second housings 62,76. The bottom wall 96 has an annular outer groove 98 facing the outer groove 82 in the flat side 78 of the first housing, a concentric annular inner groove 100 facing the inner groove 84 in the flat side 78, and a center spotface 102 facing the center bore 88 in the first housing. The outer groove 98 is separated from the inner groove 100 by an annular boss 104. The inner groove 100 is separated from the center spotface 102 by an annular boss 106. The outer groove 98 is interrupted by a stripper wall 108, FIG. 4, in the plane of the bottom wall 96 facing the stripper wall 90 on the first housing 62. The inner groove 100 is interrupted by a stripper wall 110 in the plane of the bottom wall 96 facing the stripper wall 92 on the first housing 62. The cylindrical wall 94 is interrupted by a radial stripper 112, FIG. 4, aligned with the stripper wall 108.

A disc-shaped impeller 114 of the low pressure pump 36 is supported in the cavity in the second housing 76 for rotation about the centerline 48 by a cylindrical pin 116 on the second housing. The impeller 114 has an outer set of radial vanes 118 around its periphery, a concentric inner set of radial vanes 120, and a hub 122 radially inboard of the inner set of vanes. The outer set of radial vanes 118 is separated from the inner set of radial vanes 120 by an annular first land 124 on the impeller, FIGS. 4 and 7, and the inner set of radial vanes 120 is separated from the hub 122 by a concentric annular second land 126. The driver 72 is coupled to the hub 122 by a plurality of drive tangs 128.

The outer set of radial vanes 118 cooperates with a pump channel 130 bounded by the annular outer grooves 82,98 and the cylindrical wall 94 in defining a regenerative turbine pumping stage of the low pressure pump 36. The outside diameter of the pump channel 130 is defined by the cylindrical wall 94 and the inside diameter of the pump channel 130 is defined on opposite sides of the impeller 114 by the annular bosses 86,104 on the first and second housings 62,76, respectively, where the bosses closely face the annular first land 124 on the impeller.

The inner set of radial vanes 120 cooperates with a pump channel 132 on opposite sides of the impeller 114 consisting of the annular inner grooves 84,100 in the first and second housings 62,76, respectively, in defining a side channel pumping stage of the low pressure pump 36. The inside diameter of the pump channel 132 is defined by the inside diameter of each of the annular inner grooves 84,100 where the annular bosses 89,106 closely face the annular land 126 on the impeller. The outside diameter of the pump channel 132 is defined by the outside diameter of each of the annular inner grooves 84,100 where the annular bosses 86,104 closely face the annular land 124 on the impeller.

Figure 4:
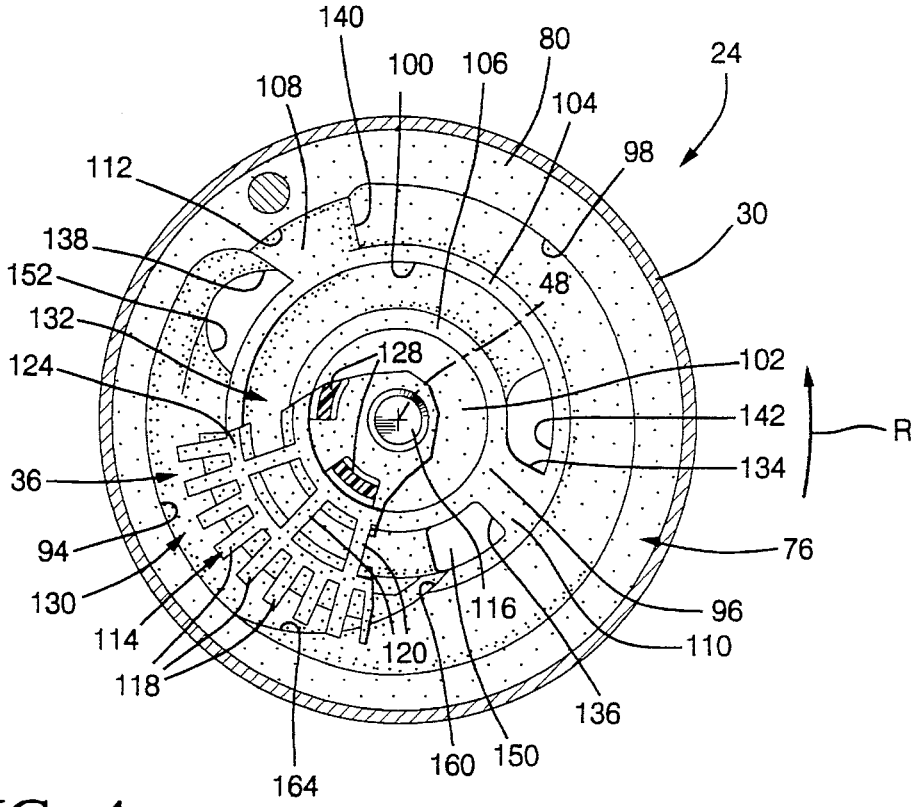
FIG. 4 is a sectional view taken generally along the plane indicated by lines 4—4 in FIG. 2.
Figure 5:
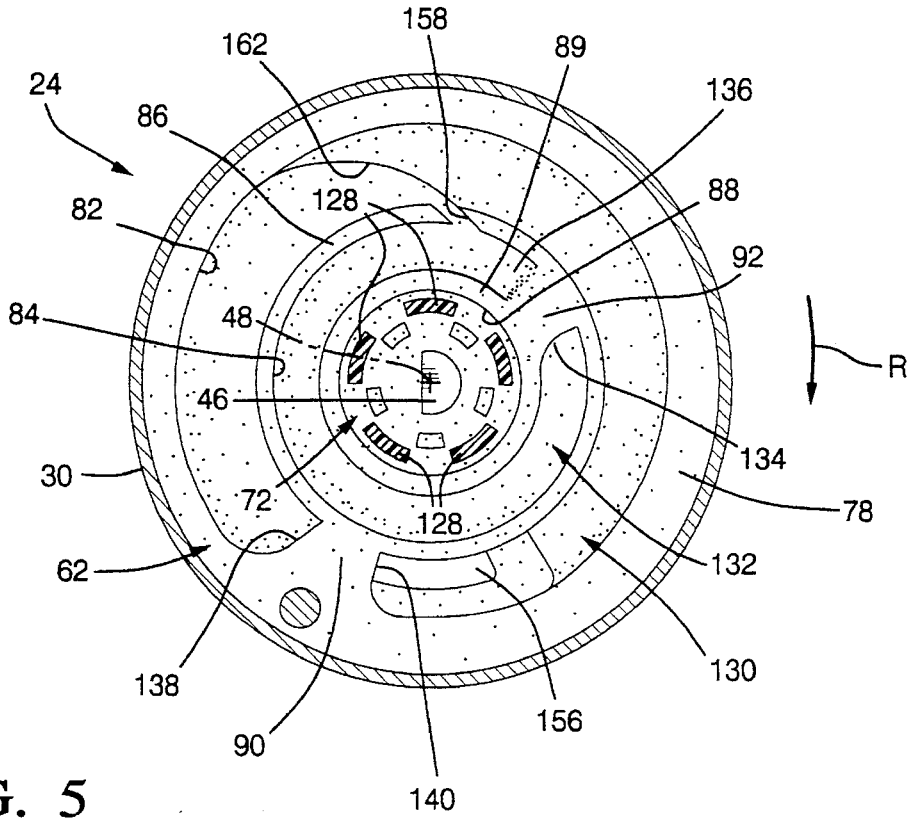
FIG. 5 is a sectional view taken generally along the plane indicated by lines 5—5 in FIG. 2.

As seen best in FIGS. 4–5, the direction of rotation of the impeller 114 when the electric motor 32 is on is indicated by a direction arrow "R" so that the pump channel 132 of the side channel pumping stage has an upstream end 134 and a downstream end 136 on opposite sides of the stripper walls 92,110. Likewise, the pump channel 130 of the turbine pumping stage has an upstream end 138 and a downstream end 140 on opposite sides of the stripper walls 90,108 and the radial stripper 112.

The side channel pumping stage of the low pressure pump communicates with the fuel tank 10 through an inlet port 142 in the bottom wall 96 on the second housing 76 at the upstream end 134 of the pump channel 132 and through a passage 144 in the second housing and a passage 146 in the reservoir 16 protected against backflow by a check valve 148. The side channel pumping stage communicates with the reservoir 16 through a discharge port 150 in the second housing 76 at the downstream end 136 of the pump channel 132. The ends of the annular groove 84 in the first housing 62 facing the inlet and discharge ports 142,150 feather from the bottom of the groove to the flat side 78 of the first housing 62 to facilitate smooth fluid flow in the pump channel 132.

The turbine pumping stage of the low pressure pump 36 communicates with the reservoir 16 through an inlet port 152 in the second housing 76 at the upstream end 138 of the pump channel 130 and through a passage 154 in the second housing. The turbine pumping stage communicates with the inlet port 66 of the gerotor pump through a discharge port 156 in the first housing 62 at the downstream end 140 of the pump channel 130. The end of the annular groove 82 in the first housing 62 facing the inlet port 152 in the second housing 76 feathers from the bottom of the groove to the flat side 78 to facilitate smooth fluid flow in the pump channel 130. Likewise, the end of the annular groove 98 in the second housing 76 facing the discharge port 156 in the first housing 62 feathers from the bottom of the groove to the flat side 80 to facilitate smooth fluid flow in the pump channel 130.

With continuing reference to FIGS. 4–5, the annular boss 86 on the first housing 62 is interrupted by a radial vapor port 158 swept back in the downstream direction. The annular boss 104 on the second housing 76 is interrupted by a radial vapor port 160 opposite the vapor port 158 swept back in the downstream direction. The radial vapor ports 158,160 effect flow communication on opposite sides of the impeller 114 from the inside diameter of the pump channel 130 of the turbine pumping stage to the outside diameter of the pump channel 132 of the side channel pumping stage at the discharge port 150 of the pump channel 132.

A sidewall step 162 in the outer groove 82 in the first housing 62 extends from the outside diameter of the pump channel 130 of the turbine pumping stage to the inside diameter thereof and sweeps back in the downstream direction to the downstream side of the radial vapor port 158 which is a smooth continuation of the sidewall step 162. A sidewall step 164 in the outer groove 98 in the second housing 76 extends from the outside diameter or the pump channel 130 of the turbine pumping stage to the inside diameter thereof and sweeps back in the downstream direction to the downstream side of the radial vapor port 160 which is a smooth continuation of the sidewall step 164. The sidewall steps 162,164 correspond to the sidewall steps described in the aforesaid U.S. patent application Ser. No.

08/391,856 (now U.S. Pat. No. 5,509,778)and gradually reduce the flow area of the pump channel 130 from maximum upstream of the sidewall steps to minimum at the radial vapor ports 158,160.

When the electric motor 32 is on, the armature shaft 46 rotates the impeller 114 and the externally toothed gear 54 of the gerotor pump. Passage of the inner set of radial vanes 120 on the impeller across the inlet port 142 induces flow of liquid fuel and entrained vapor from the fuel tank 10 into the pump channel 132 of the side channel pumping stage. The inner set of radial vanes 120 transports the liquid fuel and entrained vapor at low pressure along the length of the pump channel 132 and discharges the liquid fuel and entrained vapor into the reservoir 16 through the discharge port 150. The contents of the reservoir may be supplemented by hot liquid fuel returned from the engine of the vehicle.

Concurrently, passage of the outer set of radial vanes 118 on the impeller across the inlet port 152 induces flow of liquid fuel and entrained vapor from the reservoir 16 into the pump channel 130 of the turbine pumping stage. The outer set of radial vanes 118 transports at low pressure the liquid fuel and entrained vapor toward the discharge port 156. The entrained vapor, being less dense than liquid fuel, migrates toward the inside diameter of the pump channel 130 so that the concentration of entrained vapor in the liquid fuel increases toward the inside diameter of the pump channel 130.

The gradual flow area reduction in the pump channel 130 of the turbine pumping stage attributable to the sidewall steps 162, 164, and the downstream sweep of the sidewall steps, promotes flow of liquid fuel with a high concentration of entrained vapor through the radial vapor ports 158,160 to purge entrained vapor from liquid fuel upstream of the discharge port 156. At the same time, fuel flowing in the pump channel 132 of the side channel pumping stage induces a low pressure zone at the radially inboard ends of the radial vapor ports 158,160 which combines with the aforesaid effect of the sidewall steps 162,164 to maximize the pressure gradient across the radial vapor ports for maximum scavenging of entrained vapor from the pump channel 130 of the turbine pumping stage. Importantly, entrained vapor purged from the pump channel 130 is immediately expelled from the pump channel 132 of the side channel pumping stage through the discharge port 150 so that the effect of such purged vapor on the flow rate of liquid fuel from the fuel tank into the reservoir is minimized.

It is claimed:

1. A fuel pump for a motor vehicle including an electric motor, a high pressure pump for pumping fuel to an engine of said motor vehicle having a rotating element driven by said electric motor, and a low pressure pump for pumping fuel from a fuel tank of said motor vehicle to said reservoir and from said reservoir to said high pressure pump, characterized in that said low pressure pump comprises:

a housing means, a disc-shaped impeller rotatably supported on said housing means driven by said electric motor when said electric motor is on, an outer set of radial vanes around the periphery of said impeller, an inner set of radial vanes on said impeller concentric with said outer set of radial vanes, an annular outer groove in said housing means around said outer set of radial vanes having an inlet port connected to said reservoir and a discharge port connected to said high pressure pump and cooperating with said outer set of radial vanes in defining a regenerative turbine pumping stage of said low pressure pump operative to pump fuel and entrained vapor from said reservoir toward said high pressure pump when said electric motor is on with said entrained vapor having a maximum concentration at an inside diameter of said annular outer groove, an annular inner groove in said housing means adjacent said inner set of radial vanes having an inlet port connected to said fuel tank and a discharge port connected to said reservoir and cooperating with said inner set of radial vanes in defining a side channel pumping stage of said low pressure pump operative to pump liquid fuel from said fuel tank to said reservoir when said electric motor is on, and a first radial vapor port in said housing means effecting flow communication between an inside diameter of said annular outer channel and an outside diameter of said annular inner channel at said discharge port of said annular inner channel so that liquid fuel with a high concentration of entrained vapor is aspirated by fuel flowing in said annular inner channel through said radial vapor port into said discharge port of said annular inner channel.

2. The fuel pump for a motor vehicle recited in claim 1 further comprising:

a second radial vapor port in said housing means on an opposite side of said impeller from said first radial vapor port effecting flow communication between said inside diameter of said annular outer channel and said outside diameter of said annular inner channel at said discharge port of said annular inner channel so that liquid fuel with a high concentration of entrained vapor is aspirated by fuel flowing in said annular inner channel through each of said first and said second radial vapor ports into said discharge port of said annular inner channel.

3. The fuel pump for a motor vehicle recited in claim 2 wherein:

each of said pair of radial vapor ports is swept back in a downstream direction of said annular outer groove.

4. The fuel pump for a motor vehicle recited in claim 3 further comprising:

a pair of sidewall steps on opposite sides of said annular outer groove swept back in a downstream direction each forming a smooth continuation of a corresponding one of said pair of radial vapor ports operative to promote flow of liquid fuel having a high concentration of entrained vapor toward said inside diameter of said annular outer groove and said corresponding ones of said radial vapor ports.

5. The fuel pump for a motor vehicle recited in claim 4 wherein:

each of said pair of sidewall steps extends from an outside diameter of said annular outer groove to said inside diameter of said annular outer groove.

* * * * *